US007422318B2

(12) United States Patent
Kadomatsu et al.

(10) Patent No.: US 7,422,318 B2
(45) Date of Patent: Sep. 9, 2008

(54) IMAGE FORMING APPARATUS

(75) Inventors: Tetsuzo Kadomatsu, Kanagawa (JP); Masaaki Konno, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 350 days.

(21) Appl. No.: 11/237,956

(22) Filed: Sep. 29, 2005

(65) Prior Publication Data

US 2006/0066662 A1 Mar. 30, 2006

(30) Foreign Application Priority Data

Sep. 30, 2004 (JP) ..... 2004-288790

(51) Int. Cl.
*B41J 2/01* (2006.01)
*B41J 2/015* (2006.01)

(52) U.S. Cl. ..... 347/102; 347/21

(58) Field of Classification Search ..... 347/13, 347/16, 21, 102–105
See application file for complete search history.

(56) References Cited

U.S. PATENT DOCUMENTS

| | | | | |
|---|---|---|---|---|
| 5,365,261 | A | 11/1994 | Ozawa et al. | |
| 6,682,189 | B2 * | 1/2004 | May et al. | 347/103 |
| 2003/0067529 | A1 | 4/2003 | May et al. | |
| 2004/0070656 | A1 | 4/2004 | May et al. | |

FOREIGN PATENT DOCUMENTS

| | | | |
|---|---|---|---|
| JP | 6-40023 | A | 2/1994 |
| JP | 6-71873 | A | 3/1994 |
| JP | 6-126945 | A | 5/1994 |
| JP | 6-171076 | A | 6/1994 |
| JP | 10-157085 | A | 6/1998 |
| JP | 2000-305412 | A | 11/2000 |
| JP | 2001-179959 | A | 7/2001 |
| JP | 2002-332433 | A | 11/2002 |
| JP | 2003182064 | A | 3/2003 |

OTHER PUBLICATIONS

Google search from Wikipedia, the free encyclopedia for "squeegee"., three (3) sheets.*

* cited by examiner

*Primary Examiner*—Shih-wen Hsieh
(74) *Attorney, Agent, or Firm*—Birch, Stewart, Kolasch & Birch, LLP

(57) ABSTRACT

The image forming apparatus comprises: an ink ejection device which ejects ink comprising a coloring material dispersed or dissolved in a solvent onto a recording medium; a treatment liquid application device which applies a treatment liquid which produces a charged aggregate of the coloring material by reaction with the ink onto the recording medium, in such a manner that two liquids of the ink and the treatment liquid combine on the recording medium; a conveyance device which causes the ink ejection device and the recording medium to move relatively to each other by conveying at least one of the ink ejection device and the recording medium in a direction substantially perpendicular to a breadthways direction of the recording medium; and a solvent absorbing device which is charged to a same polarity as the aggregate of the coloring material and absorbs the solvent in the ink on the recording medium, wherein: the coloring material and the solvent are separated by reaction of the two liquids which have combined on the recording medium; the solvent is then absorbed by the solvent absorbing device; and the coloring material is then fixed onto the recording medium.

15 Claims, 10 Drawing Sheets

IMAGE FORMING APPARATUS

BACKGROUND OF THE INVENTION

1. Field of the Invention

The present invention relates to an image forming apparatus, and more particularly, to an image forming apparatus which forms images on a recording medium, by ejecting droplets from nozzles.

2. Description of the Related Art

An inkjet type of image forming apparatus forms an image on a medium (recording medium) by ejecting ink droplets from nozzles provided in a print head. Generally, the ink used in an image forming apparatus of this kind has a large content of solvent, such as water, organic solvent, or the like, in order to reduce the viscosity of the ink.

When ink having reduced viscosity of this kind is ejected onto a permeable medium in which the ink permeates into the medium and becomes fixed inside the medium, effects of the following kind may occur, due to inadequate removal of the solvent component inside the ink. Namely, the ink may permeate and spread to a larger extent than the prescribed dot size during the permeation of the ink into the medium, the boundaries between the dots may become blurred, the spreading of the dots may be irregular rather than uniform, and the dot shape may be streaked, or the like. Spreading of the dots in this way is called "bleeding".

Furthermore, in the case of a non-permeable medium in which the ink principally becomes fixed on the surface of the medium, unless the solvent component in the ink is removed, the ink cannot become fixed to the surface of the medium and this is an obstacle to high-speed printing.

Therefore, technology for removing the solvent from the ink deposited on the medium has been proposed (see, for example, Japanese Patent Application Publication Nos. 6-40023, 6-71873, 6-126945, 6-171076, 2000-305412, 10-157085 and 2001-179959).

Japanese Patent Application Publication No. 6-40023 discloses a transfer type inkjet printer using ink in which colored charged particles (coloring material) are dispersed in an oil-based solvent. In Japanese Patent Application Publication No. 6-40023, ions of the same polarity as the colored charged particles inside the ink are irradiated onto an ink image on a transfer medium, thereby provisionally fixing the colored charged particles forming the ink, on the surface of the transfer medium, and the solvent in the ink image on the transfer medium is then removed by means of a solvent removing device using water or an aqueous surfactant, and a concentrated ink image consisting of the colored charged particles only is transferred to the medium.

Japanese Patent Application Publication No. 6-71873 discloses technology for improving Japanese Patent Application Publication No. 6-40023. More specifically, in order to resolve the problem of image disturbances which may occur when the solid coloring component in the ink is not in a uniform charged state, a device for supplementing the charged particles of a particular polarity in the ink is provided in the ink flow path between the ink tank and the head, and solid coloring component of a polarity other than the prescribed charging polarity is removed previously, whereupon an ink image is formed on the transfer medium.

Furthermore, similarly to Japanese Patent Application Publication No. 6-40023, Japanese Patent Application Publication No. 6-126945 discloses a transfer type inkjet printer in which ions of the same polarity as colored charged particles (coloring material) in an ink are irradiated onto an ink image on a transfer medium, thereby provisionally fixing the colored charged particular constituting the ink, on the surface of the transfer medium, whereupon a metallic mesh supplied with a voltage, a polyethylene tetrafluoride mesh having a uniform pore diameter which is sufficiently smaller than the size of the colored charged particles, and a roller having a plurality of metallic pins, are used as solvent removing devices.

Japanese Patent Application Publication No. 6-171076 discloses a transfer type inkjet printer provided with a solvent recovery device which recovers the oil-based solvent from the water or the aqueous surfactant, in a solvent removing device of the transfer type inkjet printer disclosed in Japanese Patent Application Publication No. 6-40023.

Japanese Patent Application Publication No. 2000-305412 discloses an image fixing device which removes solvent before an image is fixed into the medium. According to Japanese Patent Application Publication No. 2000-305412, a voltage is applied between a solvent removing roller and an opposing roller, before entering a fixing step, causing charged colored micro-particles (coloring material) to aggregate on the medium, and the majority of the solvent which has been separated from the micro-particles is removed by the solvent removing roller.

Japanese Patent Application Publication No. 10-157085 discloses a recording apparatus which ejects droplets of oil-based ink onto an intermediate transfer body having a surface made of a silicon member. According to Japanese Patent Application Publication No. 10-157085, when the ink adheres to the silicon member, the viscosity of the ink is increased at the boundary between the silicon member and the ink, the ink in the vicinity of the boundary solidifies completely, and the surface of the adhering ink layer assumes a state of increased viscosity. Thereupon, the ink is transferred in this state to the medium, and printing results having little bleeding are obtained.

Japanese Patent Application Publication No. 2001-179959 discloses an image forming apparatus in which a solvent absorbing body having a surface which has good separating characteristics with respect to the dye or pigment-based coloring agent (coloring material) in the ink is placed in contact with the ink on the medium, and absorbs the solvent in the ink. According to Japanese Patent Application Publication No. 2001-179959, when using a dye-based ink, the coloring agent and the solvent are separated by means of an aggregation promoter which causes the dye to aggregate and separate.

However, the technology disclosed in Japanese Patent Application Publication Nos. 6-40023, 6-71873, 6-126945, 6-171076 and 10-157085 can only be applied to transfer type recording apparatuses which use inks having an oil-based solvent, and they cannot be adapted to recording apparatuses which eject ink droplets directly onto the medium.

Japanese Patent Application Publication No. 2000-305412 simultaneously applies a voltage to a solvent removal roller and absorbs solvent on the medium by means of a solvent absorbing roller, and hence there is a risk that the coloring material will be absorbed into the solvent removing roller together with the solvent, before the coloring material aggregate on the medium.

Japanese Patent Application Publication No. 2001-179959 increases the separating characteristics between a coloring material and a solvent absorbing body, but there is still a risk that coloring material will adhere to the solvent absorbing body, together with the solvent.

In this way, as yet, there has been no proposal for an image forming apparatus which is able to remove solvent swiftly and reliably from ink deposited on a medium.

SUMMARY OF THE INVENTION

The present invention has been contrived in view of the foregoing circumstances, an object thereof being to provide an image forming apparatus which is able to remove solvent swiftly and reliably from ink deposited on a medium.

In order to attain the aforementioned object, the present invention is directed to an image forming apparatus, comprising: an ink ejection device which ejects ink comprising a coloring material dispersed or dissolved in a solvent onto a recording medium; a treatment liquid application device which applies a treatment liquid which produces a charged aggregate of the coloring material by reaction with the ink onto the recording medium, in such a manner that two liquids of the ink and the treatment liquid combine on the recording medium; a conveyance device which causes the ink ejection device and the recording medium to move relatively to each other by conveying at least one of the ink ejection device and the recording medium in a direction substantially perpendicular to a breadthways direction of the recording medium; and a solvent absorbing device which is charged to a same polarity as the aggregate of the coloring material and absorbs the solvent in the ink on the recording medium, wherein: the coloring material and the solvent are separated by reaction of the two liquids which have combined on the recording medium; the solvent is then absorbed by the solvent absorbing device; and the coloring material is then fixed onto the recording medium.

According to the present invention, by combining ink and a treatment liquid on the medium (recording medium), an aggregate of the coloring material is produced and the coloring material and solvent in the ink are separated. Furthermore, since the aggregate of coloring material and the solvent absorbing device are charged to the same polarity, a force of electrostatic repulsion acts respectively on the aggregate and the solvent absorbing device in opposite directions, and therefore it is possible to prevent coloring material from adhering onto the solvent removing device. Consequently, it is possible to remove solvent from the ink on the medium, swiftly and reliably.

Preferably, the treatment liquid application device is a treatment liquid ejection device which ejects droplets of the treatment liquid onto the recording medium.

Alternatively, it is also preferable that the treatment liquid application device is a treatment liquid coating device which coats the recording medium with the treatment liquid.

As a mode for applying the treatment liquid to the recording medium, there is a mode in which the treatment liquid is ejected onto the recording medium in the form of liquid droplets, and a mode in which the recording medium is coated with the treatment liquid.

Preferably, the conveyance device is charged to a polarity opposite to the aggregate of the coloring material and conveys the recording medium in the direction substantially perpendicular to the breadthways direction of the recording medium. Accordingly, the aggregate of coloring material is drawn toward the conveyance device which is charged to an opposite polarity, and therefore, the solvent removing device is able to remove the solvent from the ink on the recording medium in an even more reliable fashion.

Preferably, at least a surface of the solvent removing device is constituted by a porous member, a diameter of pores of the porous member being smaller than a particle diameter of the aggregate of the coloring material. Accordingly, it is possible reliably to prevent coloring material from being absorbed by the solvent absorbing device.

Preferably, a shape of the porous member is one of a belt shape and a roller shape. Accordingly, a belt-shaped or roller-shaped porous member is able to absorb solvent from the ink on the recording medium while rotating so as to maintain a relative speed of zero with respect to the recording medium. Therefore, image deterioration due to rubbing between the recording medium and the solvent removing device can be prevented.

According to the present invention, by combining ink and a treatment liquid on the medium, an aggregate of the coloring material is produced and the coloring material and solvent in the ink are separated. Furthermore, since the aggregate of coloring material and the solvent absorbing device are charged to the same polarity, a force of electrostatic repulsion acts respectively on the aggregate and the solvent absorbing device in opposite directions, and therefore it is possible to prevent coloring material from adhering onto the solvent removing device.

Consequently, it is possible to remove solvent from the ink on the medium, swiftly and reliably.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
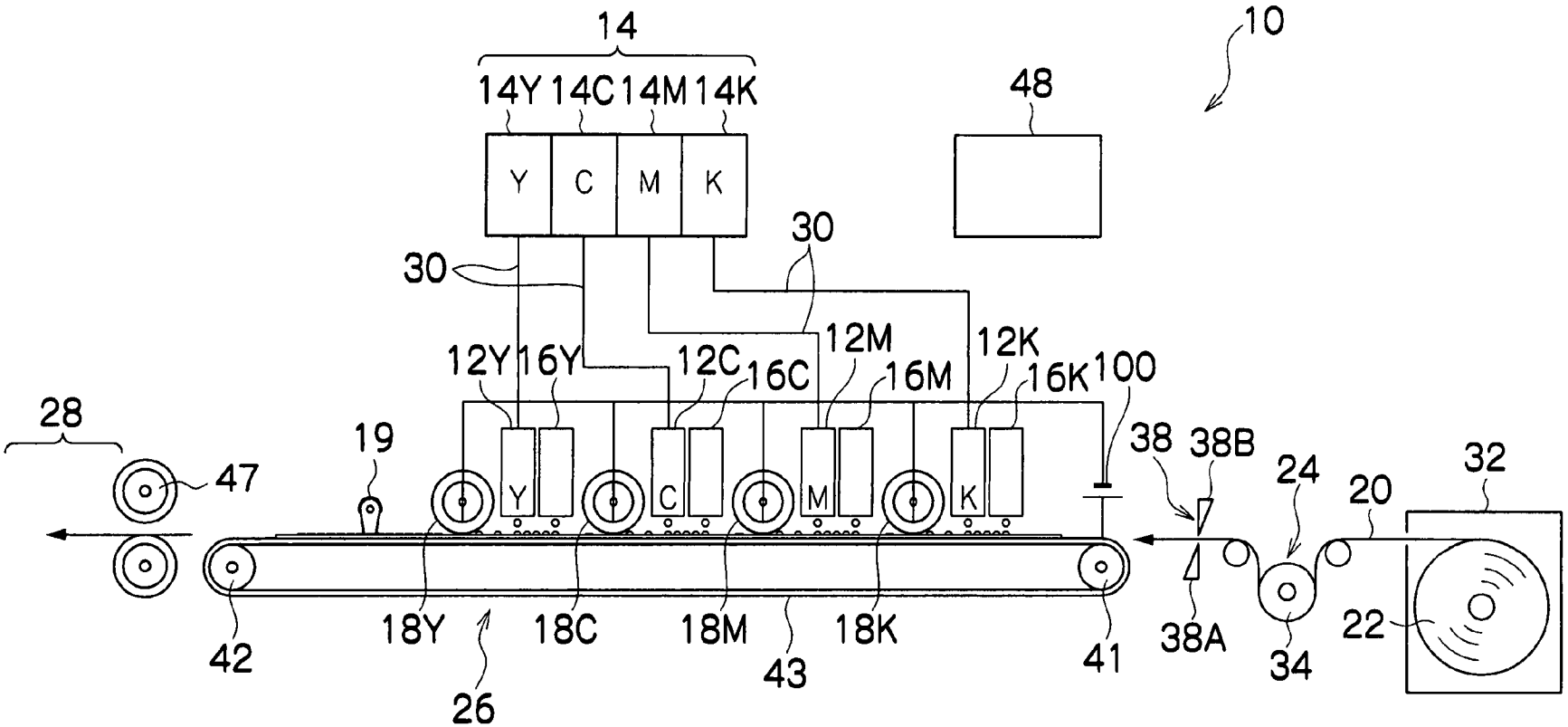
FIG. 1 is a general schematic drawing of an inkjet recording apparatus according to an embodiment of the present invention.

FIG. 1 is a general schematic drawing showing one embodiment of an inkjet recording apparatus relating to the present invention. As shown in FIG. 1, this inkjet recording apparatus 10 chiefly comprises: a plurality of print heads 12K, 12M, 12C and 12Y provided corresponding to respective ink colors; an ink storing and loading unit 14 which stores ink to be supplied to the respective print heads 12K, 12M, 12C and 12Y; a post-drying unit 19 disposed on the downstream side of the print head 12Y in terms of the paper conveyance direction (the leftward direction in FIG. 1); a medium supply unit 22 for supplying a medium (recording medium) 20; a decurling unit 24 for removing curl from the medium 20; a conveyance unit 26, disposed facing the nozzle surface (ink ejection surface) of the print heads 12K, 12M, 12C and 12Y, for conveying the medium 20 while keeping the medium 20 flat; and a paper output unit 28 for outputting recorded paper (printed matter) to the exterior.

The ink storing and loading unit 14 has ink tanks 14K, 14M, 14C, and 14Y for storing the inks of K, C, M and Y to be supplied to the print heads 12K, 12M, 12C, and 12Y, and the tanks are connected to the print heads 12K, 12M, 12C, and 12Y by means of prescribed tubing channels 30. The ink storing and loading unit 14 has a warning device (for example, a display device or an alarm sound generator) for warning when the remaining amount of any ink is low, and has a mechanism for preventing loading errors among the colors.

In FIG. 1, a single magazine for rolled paper (continuous paper) is shown as an example of the medium supply unit 22; however, a plurality of magazines with paper differences such as paper width and quality may be jointly provided. Moreover, papers may be supplied in cassettes that contain cut papers loaded in layers and that are used jointly or in lieu of magazines for rolled papers.

In the case of a configuration in which a plurality of types of media can be used, it is preferable that an information recording medium such as a bar code and a wireless tag containing information about the type of media is attached to the magazine, and by reading the information contained in the information recording medium with a predetermined reading device, the type of media to be used is automatically determined, and ink droplet ejection is controlled so that the ink droplets are ejected in an appropriate manner in accordance with the type of media.

The medium 20 delivered from the medium supply unit 22 retains curl due to having been loaded in the magazine 32. In order to remove the curl, heat is applied to the medium 20 in the decurling unit 24 by a heating drum 34 in the direction opposite to the curl direction in the magazine 32. In this, the heating temperature is preferably controlled in such a manner that the medium 20 has a curl in which the surface on which the print is to be made is slightly rounded in the outward direction.

In the case of the configuration in which roll paper is used, a cutter 38 is provided as shown in FIG. 1, and the continuous paper is cut into a desired size by the cutter 38. The cutter 38 has a stationary blade 38A, of which length is not less than the width of the conveyor pathway of the medium 20, and a round blade 38B, which moves along the stationary blade 38A. The stationary blade 38A is disposed on the reverse side of the printed surface of the medium, and the round blade 38B is disposed on the printed surface side across the conveyor pathway. When cut papers are used, the cutter 38 is not required.

After decurling in the decurling unit 24, the cut medium 20 is delivered to the conveyance unit 26. The conveyance unit 26 has a configuration in which an endless conveyance belt (electrostatic attraction belt) 43 is set around rollers 41 and 42 in such a manner that at least the portion of the endless belt 43 facing the nozzle faces of the respective print heads 12K, 12M, 12C and 12Y forms a flat plane.

The conveyance belt 43 is constituted by a conducting member, and is connected electrically to a DC power supply 100. The other end of the DC power supply 100 is connected electrically to porous rollers 18K, 18M, 18C and 18Y, which are described hereinafter. When a DC voltage is supplied from the DC power supply 100, an electric field is created between the conveyance belt 43 and the porous rollers 18K, 18M, 18C and 18Y, and due to the effects of electrostatic attraction, the medium 20 is attracted to and held on the conveyance belt 43.

The conveyance belt 43 is driven in the counterclockwise direction in FIG. 1 by the motive force of a motor 134 (not shown in FIG. 1, but shown in FIG. 7) being transmitted to at least one of the rollers 41 and 42, which the conveyance belt 43 is set around, and the medium 20 held on the conveyance belt 43 is conveyed from right to left in FIG. 1.

The print heads 12K, 12M, 12C and 12Y are full line heads having a length corresponding to the maximum width of the medium 20 used with the inkjet recording apparatus 10, and comprising a plurality of nozzles for ejecting ink arranged on a nozzle face through a length exceeding at least one edge of the maximum-size medium 20 (namely, the full width of the printable range).

The print heads 12K, 12C, 12M, and 12Y are arranged in color order (black (K), magenta (M), cyan (C), yellow (Y)) from the upstream side in the delivery direction of the medium 20, and these respective print heads 12K, 12M, 12C and 12Y are fixed extending in a direction (the main scanning direction) which is substantially perpendicular to the conveyance direction of the medium 20 (the sub-scanning direction).

A color image can be formed on the medium 20 by ejecting inks of different colors from the print heads 12K, 12C, 12M and 12Y, respectively, onto the medium 20 while the medium 20 is conveyed by the conveyance unit 26.

By adopting a configuration in which full line type print heads 12K, 12M, 12C and 12Y having nozzles rows covering the full paper width are provided for the separate colors in this way, it is possible to record an image on the full surface of the medium 20 by performing just one operation of moving the medium 20 relatively with respect to the print heads 12K, 12M, 12C and 12Y in the conveyance direction of the medium 20 (the sub-scanning direction), (in other words, by means of one sub-scanning action). A single pass image forming apparatus of this kind is able to print at high speed in comparison with a shuttle scanning system in which an image is printed by moving a print head back and forth reciprocally in the main scanning direction, and hence print productivity can be improved.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added. Furthermore, there are no particular restrictions on the sequence in which the print heads of respective colors are arranged.

The post-drying unit 19 disposed on the downstream side of the print head 12Y has a length corresponding to the maximum width of the medium 20, similarly to the print heads 12K, 12M, 12C and 12Y, and it is fixed extending in a direction substantially perpendicular to the conveyance direction of the medium 20. The post-drying unit 19 functions as a device for promoting the drying of the surface of the time formed on the medium 20, and it is constituted by an infrared heater, or the like.

In this way, the medium 20 (the created printed matter) that has passed the post-drying unit 19 is output from the paper output unit 28 via nip rollers 47. Although not shown in FIG.

1, the paper output unit 28 is provided with a sorter for collecting images according to print orders.

The inkjet recording apparatus 10 relating to the present embodiment also comprises, as a device for removing solvent from the ink on the medium 20, treatment liquid heads 16K, 16M, 16C and 16Y and porous rollers 18K, 18M, 18C and 18Y provided respectively on the upstream side and the downstream side of the print heads 12K, 12M, 12C and 12Y in terms of the paper conveyance direction. The treatment liquid heads 16K, 16M, 16C and 16Y are connected to a treatment liquid tank 48 which stores treatment liquid to be supplied to the treatment liquid heads 16K, 16M, 16C and 16Y, via tubing channels (not shown). The composition and other features of these heads are described in detail below.

Structure of Print Head

Next, the structure of a print head will be described. The print heads 12K, 12M, 12C and 12Y provided for the respective ink colors have the same structure, and a reference numeral 50 is hereinafter designated to a representative example of these print heads.

Figure 2A:
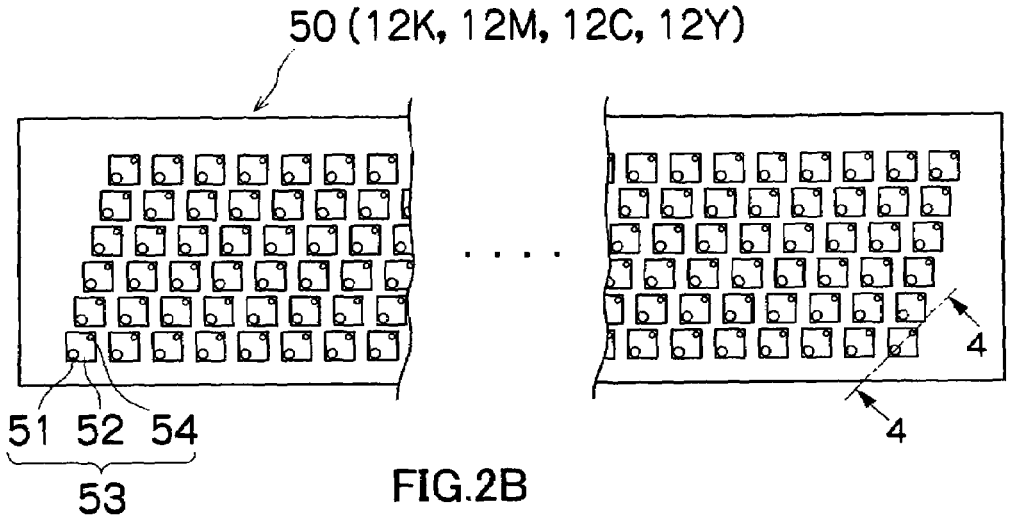
FIG. 2A is plan view perspective diagram showing an example of the structure of a print head.
Figure 2B:
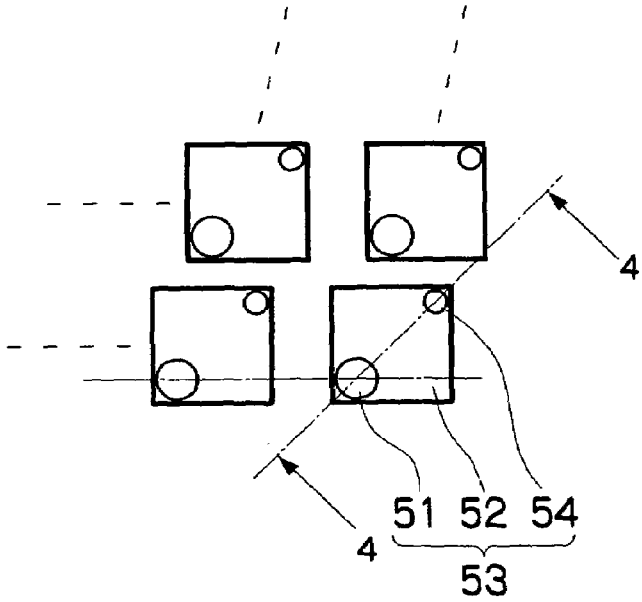
FIG. 2B is an enlarged diagram of a portion of same.

FIG. 2A is a plan view perspective diagram showing an example of the composition of a print head 50, and FIG. 2B is an enlarged diagram of a portion of same. Furthermore, FIG. 3 is a plan view perspective diagram showing a further example of the composition of a print head 50, and FIG. 4 is a cross-sectional diagram showing a three-dimensional composition of one liquid droplet ejection element (one ink chamber unit corresponding to one nozzle) (being a cross-sectional view along line 4-4 in FIG. 2).

In order to achieve a high density of the dot pitch printed onto the surface of the medium 20, it is necessary to achieve a high density of the nozzle pitch in the print head 50. As shown in FIG. 2 to FIG. 4, the print head 50 according to the present embodiment has a structure in which a plurality of ink chamber units (liquid droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the print head (the direction substantially perpendicular to the paper conveyance direction) is reduced (high nozzle density is achieved).

Figure 3:
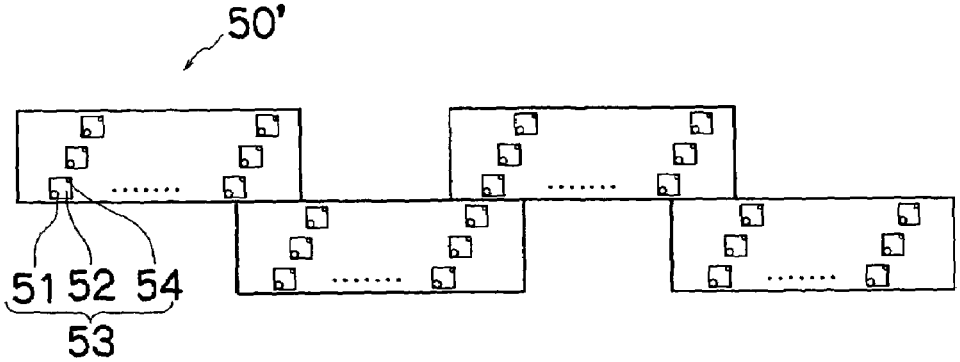
FIG. 3 is a plan view perspective diagram showing a further example of the structure of a print head.
Figure 4:
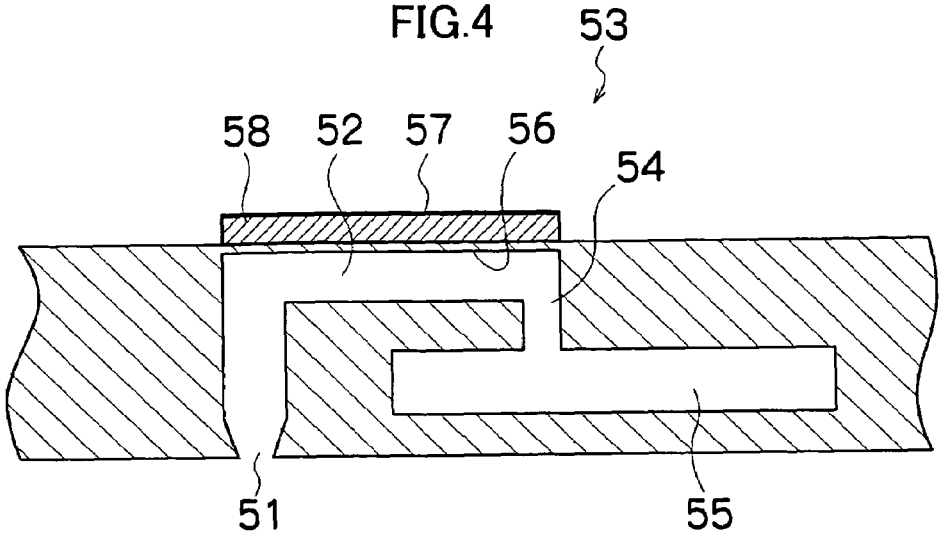
FIG. 4 is a cross-sectional diagram along line 4-4 in FIGS. 2A and 2B.

Furthermore, instead of the composition in FIG. 2, as shown in FIG. 3, a full line head having nozzle rows of a length corresponding to the entire width of the medium 20 can be formed by arranging and combining, in a staggered matrix, short head units 50' each having a plurality of nozzles 51 arrayed in a two-dimensional fashion.

As shown in FIGS. 2A and 2B, the planar shape of the pressure chamber 52 provided for each nozzle 51 is substantially a square, and the nozzle 51 and an inlet for supplied ink (supply port) 54 are disposed at respective corners on a diagonal line of the square.

As shown in FIG. 4, the pressure chamber 52 is connected to a common channel 55 through the supply port 54. The common channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is joined to a pressure plate (common electrode) 56 which forms the upper face of the pressure chamber 52, and the actuator 58 is deformed when a drive voltage is supplied to the individual electrode 57 and common electrode 56, and the volume of the pressure chamber 52 changes, thereby causing ink to be ejected from the nozzle 51 as a result of the change in pressure. A piezoelectric body, such as a piezo element, is suitable as the actuator 58. When ink is ejected, new ink is supplied to the pressure chamber 52 from the common flow channel 55 through the supply port 54.

Figure 5:
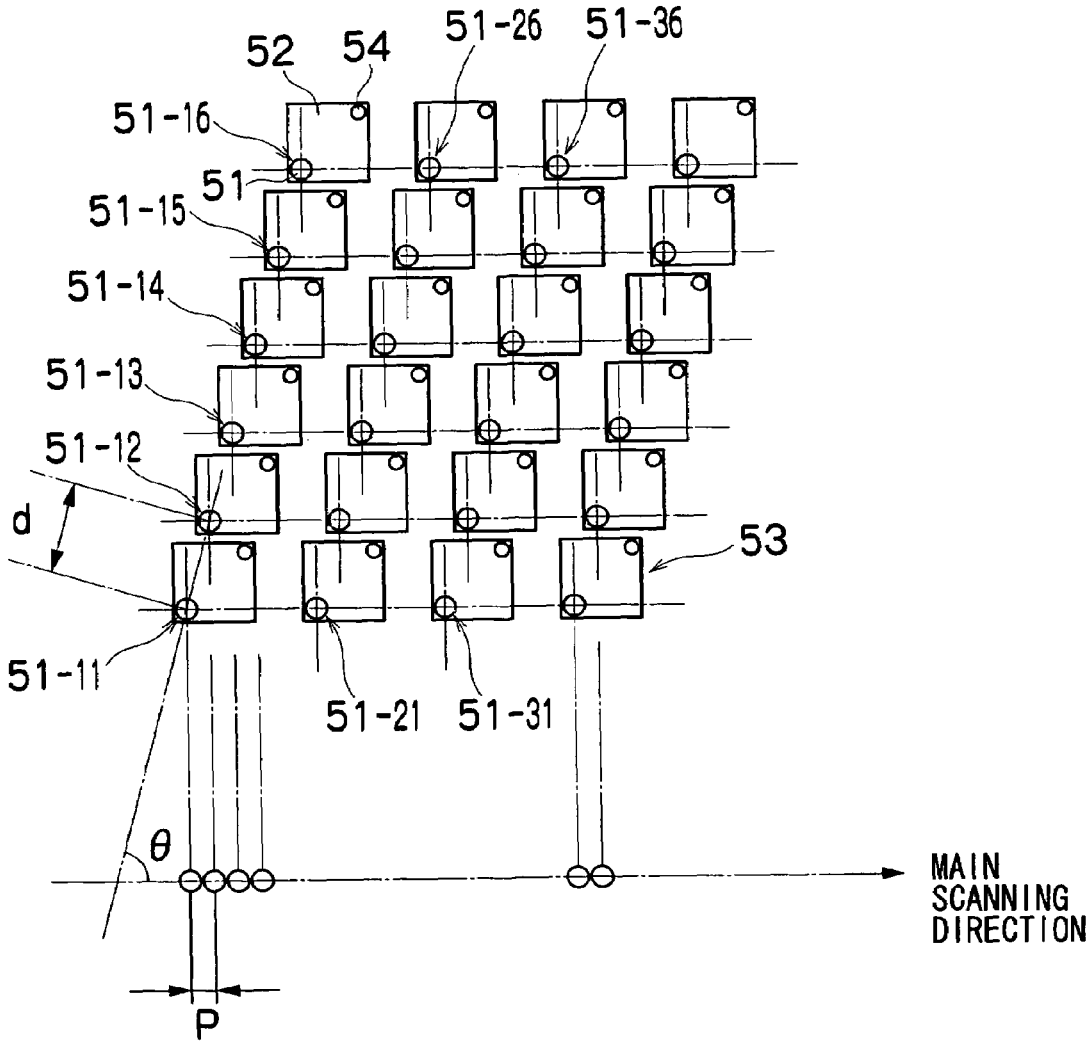
FIG. 5 is an enlarged view showing an example of the nozzle arrangement in the print head shown in FIG. 2.

As shown in FIG. 5, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of θ with respect to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density.

In a full-line head comprising rows of nozzles that have a length corresponding to the entire width of the image recordable width, "main scanning" is defined as to print one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the medium 20 by sequentially driving the nozzles 51-11, 51-12, . . . , 51 -16 in accordance with the conveyance velocity of the medium 20.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example shown. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Configuration of Ink Supply System

Figure 6:
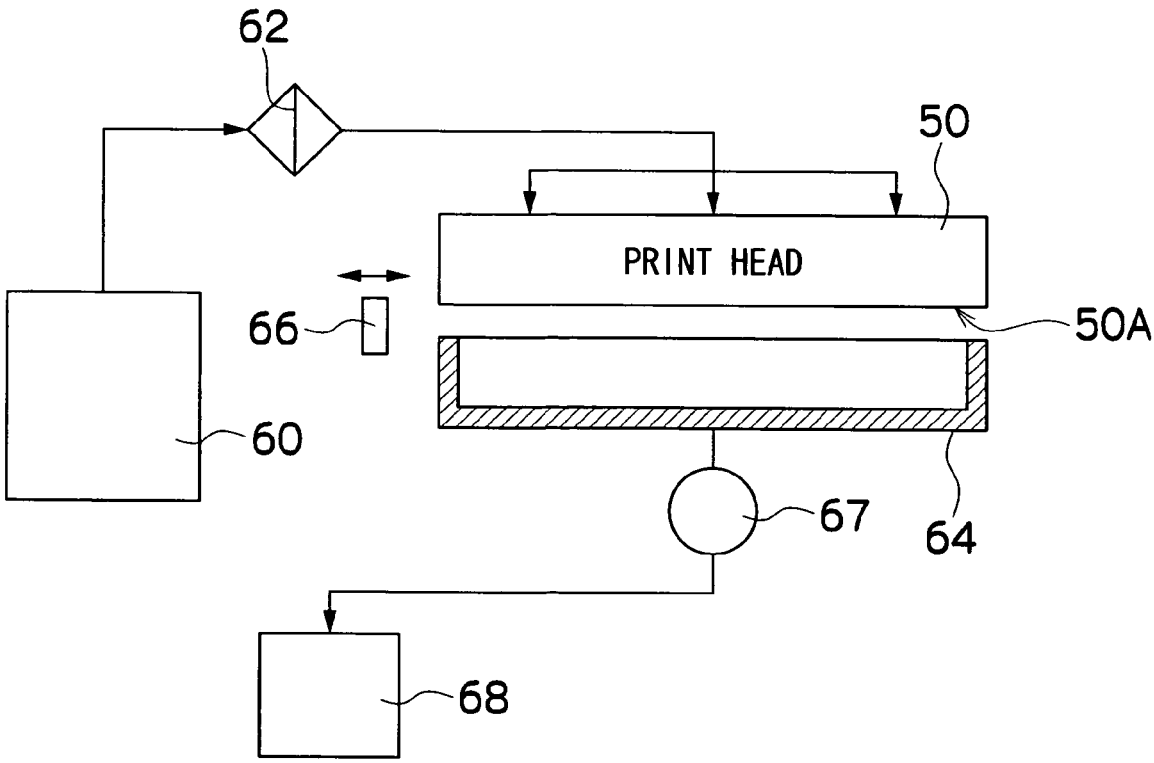
FIG. 6 is a schematic drawing showing the composition of an ink supply system in the inkjet recording apparatus.

FIG. 6 is a schematic drawing showing the configuration of the ink supply system in the inkjet recording apparatus 10.

The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the print head 50 as shown in FIG. 6. The filter mesh size in the filter 62 is preferably equivalent to or less than the diameter of the nozzle. Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face 50A is thereby covered with the cap 64.

The cleaning blade 66 is formed from an elastic member made of rubber or the like, and is capable of sliding over the nozzle face 50A of the print head 50 by means of a blade moving mechanism not shown in the drawing. When an ink droplet or foreign object adheres to the nozzle face 50A, the nozzle face 50A can be wiped clean by sliding the cleaning blade 66 over the nozzle face 50A.

During printing or standby, when the frequency of use of specific nozzles 51 is reduced and ink viscosity increases in the vicinity of the nozzles, a preliminary discharge is made to eject the degraded ink toward the cap 64.

Also, when bubbles have become intermixed in the ink inside the print head 50 (inside the pressure chamber), the cap 64 is placed on the print head 50, the ink inside the pressure chamber 52 (the ink in which bubbles have become intermixed) is removed by suction with a suction pump 67, and the suction-removed ink is sent to a collection tank 68. This suction action entails the suctioning of degraded ink of which viscosity has increased (hardened) also when initially loaded into the print head 50, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink of which viscosity has increased in the vicinity of the nozzle toward the ink receptor. After the nozzle face 50A is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, or when ink viscosity inside the nozzle 51 reaches a predetermined level or over, ink can no longer be ejected from the nozzle 51 even if the actuator 58 is operated. In a case of this kind, a cap 64 is placed on the nozzle surface of the print head 50, and the ink containing air bubbles or the ink of increased viscosity inside the pressure chambers 52 is suctioned by a pump 67.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Next, the control system of the inkjet recording apparatus 10 will be described.

Figure 7:
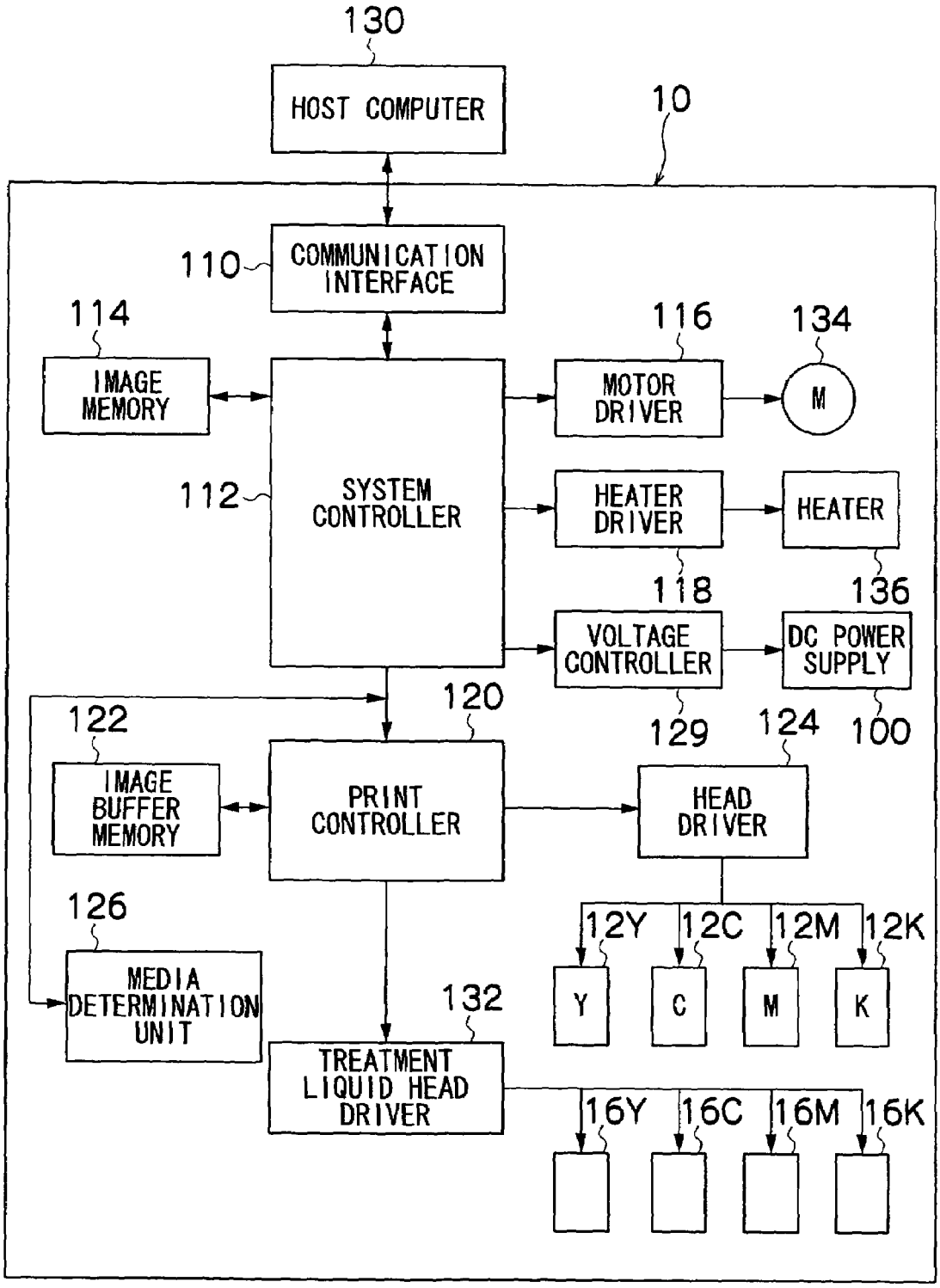
FIG. 7 is a principal block diagram showing the system composition of the inkjet recording apparatus.

FIG. 7 is a principal block diagram showing the system composition of the inkjet recording apparatus 10. The inkjet recording apparatus 10 comprises a communication interface 110, a system controller 112, an image memory 114, a motor driver 116, a heater driver 118, a voltage controller 129, a print controller 120, an image buffer memory 122, a head driver 124, a media determination unit 126, a treatment liquid head driver 132, and the like.

The communication interface 110 is an interface unit for receiving image data transmitted by a host computer 130. For the communication interface 110, a serial interface, such as USB, IEEE 1394, the Internet, or a wireless network, or the like, or a parallel interface, such as a Centronics interface, or the like, can be used. It is also possible to install a buffer memory (not shown) for achieving high-speed communication.

The image data sent from the host computer 130 is received by the inkjet recording apparatus 10 through the communication interface 110, and is temporarily stored in the image memory 114. The image memory 114 is a storage device for temporarily storing images inputted through the communication interface 110, and data is written and read to and from the image memory 114 through the system controller 112. The image memory 114 is not limited to a memory composed of semiconductor elements, and a hard disk drive or another magnetic medium may be used.

The system controller 112 is a control unit for controlling the various sections, such as the communication interface 110, the image memory 114, the motor driver 116, the heater driver 118, the voltage controller 129, and the like. The system controller 112 is constituted by a central processing unit (CPU) and peripheral circuits thereof, and the like, and in addition to controlling communication with the host computer 130 and controlling reading and writing from and to the image memory 114, or the like, it also generates a control signal for controlling the motor 134 of the conveyance system, the heater 136 and the DC power supply 100.

The motor driver 116 is a driver (drive circuit) which drives the motor 134 in accordance with instructions from the system controller 112. The heater driver 118 is a driver for driving the heater 136 of the heating drum 34, and other sections, in accordance with instructions from the system controller 112.

The voltage controller 129 controls the voltage generated by the DC power supply 100 in accordance with instructions from the system controller 112.

The print controller 120 is a control unit having a signal processing function for performing various treatment processes, corrections, and the like, in accordance with the control implemented by the system controller 112, in order to generate a signal for controlling printing, from the image data in the image memory 114, and it supplies the print control signal (dot data) thus generated to the head driver 124 and the treatment liquid head driver 132. Prescribed signal processing is carried out in the print controller 120, and the ejection amount and the ejection timing of ink droplets from the print heads 12K, 12M, 12C and 12Y of the respective colors are controlled via the head driver 124, on the basis of the image data. By this means, prescribed dot size and dot positions can be achieved. Furthermore, similarly, the ejection amount and the ejection timing of the treatment liquid are controlled in the treatment liquid heads 16K, 16M, 16C and 16Y by means of the treatment liquid head driver 132.

The image buffer memory 122 is provided in the print controller 120, and image data, parameters, and other data are temporarily stored in the image buffer memory 122 when image data is processed in the print controller 120. FIG. 7 shows a mode in which the image buffer memory 122 is attached to the print controller 120; however, the image memory 114 may also serve as the image buffer memory 122. Also possible is a mode in which the print controller 120 and the system controller 112 are integrated to form a single processor.

The head driver 124 drives the actuators 58 which drive ejection in the respective print heads 12K, 12M, 12C and 12Y, on the basis of the dot data supplied from the print controller 120. A feedback control system for maintaining constant drive conditions for the print heads may be included in the head driver 124.

Similarly to the head driver 124, the treatment liquid head driver 132 drives the ejection drive actuators (not shown) of the treatment liquid heads 16K, 16M, 16C and 16Y, on the basis of the dot data supplied by the print controller 120.

The image data to be printed is externally inputted through the communication interface 110, and is stored in the image memory 114. At this stage, RGB image data is stored in the image memory 114, for example. The image data stored in the image memory 114 is sent to the print controller 120 through the system controller 112, and is converted into dot data for each ink color by a known dithering algorithm, random dithering algorithm or another technique in the print controller 120.

The print heads 12K, 12M, 12C and 12Y are driven on the basis of the dot data thus generated by the print controller 120, so that ink is ejected from the print heads 12K, 12M, 12C and 12Y. By controlling ink ejection from the print heads 12K, 12M, 12C, 12Y in synchronization with the conveyance speed of the medium 20, an image is formed on the medium 20. Furthermore, treatment liquid is ejected from the treatment liquid heads 16K, 16M, 16C and 16Y at this stage, and the solvent is removed from the ink on the medium 20 by means of a solvent removal method described hereinafter.

The media determination unit 126 is a device for determining the paper type and size of the medium 20. This section uses, for example, a device for reading in information such as bar codes attached to the magazine 32 in the paper supply unit 22, or sensors disposed at a suitable position in the paper conveyance path (a paper width determination sensor, a sensor for determining the thickness of the paper, a sensor for determining the reflectivity of the paper, and so on). A suitable combination of these elements may also be used. Furthermore, it is also possible to adopt a composition in which information relating to the paper type, size, or the like, is specified by means of inputs made via a prescribed user interface, instead of or in conjunction with such automatic determination devices.

Information obtained by the media determination unit 126 is reported to the system controller 112 and/or the print controller 120, and is used to control ink ejection.

Solvent Removal Method

Next, a method for removing solvent from the ink on the medium 20 will be described. Firstly, a step of separating the solvent and the coloring material in the ink is described.

Figure 8:
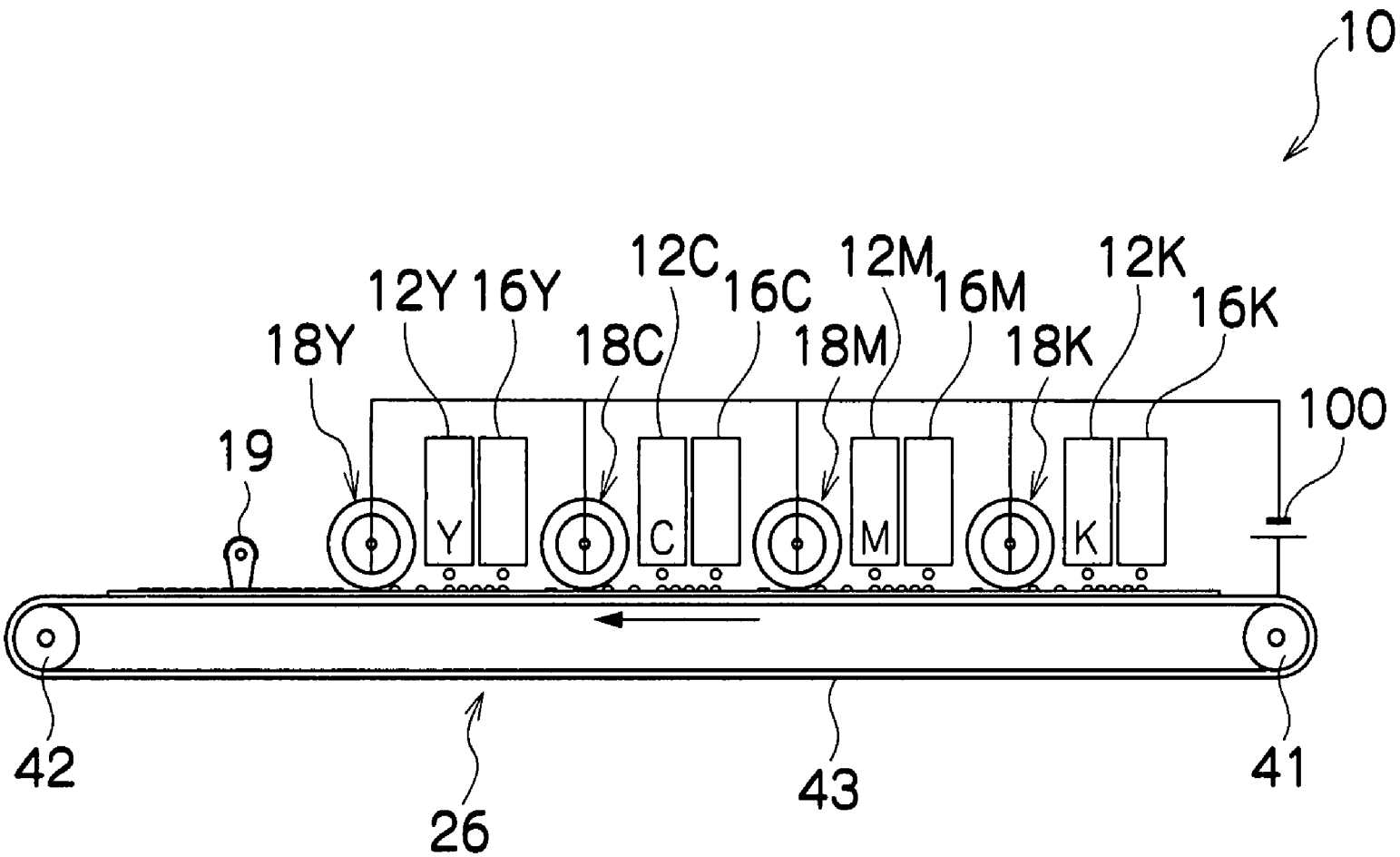
FIG. 8 is a schematic drawing showing the principal composition of the inkjet recording apparatus shown in FIG. 1.

FIG. 8 is a schematic drawing showing the principal composition of the inkjet recording apparatus 10 shown in FIG. 1. As shown in FIG. 8, as well as providing treatment liquid heads 16K, 16M, 16C and 16Y on the upstream side of respective print heads 12K, 12M, 12C and 12Y in terms of the paper conveyance direction (the direction indicated by the arrow in FIG. 8), porous rollers 18K, 18M, 18C and 18Y are provided on the downstream side of the print heads 12K, 12M, 12C and 12Y in terms of the paper conveyance direction.

The treatment liquid heads 16K, 16M, 16C and 16Y are similar to the print heads 12K, 12M, 12C and 12Y (see FIG. 2 to FIG. 5), and treatment liquid is ejected form the nozzles of the treatment liquid heads 16K, 16M, 16C and 16Y onto the medium 20. This treatment liquid is described hereinafter.

The print heads 12K, 12M, 12C and 12Y, and the corresponding treatment liquid heads 16K, 16M, 16C and 16Y are equivalent to the "ejection device" in the means for resolving the problems according to the present invention. When implementing the present invention, the ejection device is not limited to a composition which is divided into print heads and treatment liquid heads as in the present embodiment, and it is of course also possible to adopt a composition in which these heads are integrated together.

The DC power supply 100 is connected electrically to the conveyance belt 43 and the porous rollers 18K, 18M, 18C and 18Y, in such a manner that the conveyance belt 43 forms a positive electrode, and the porous rollers 18K, 18M, 18C and 18Y form a negative electrode. Consequently, the surface potential of the conveyance belt 43 is higher than the surface potential of the porous rollers 18K, 18M, 18C and 18Y, and hence an electric field is applied to the medium 20 held between the conveyance belt 43 and the porous rollers 18K, 18M, 18C and 18Y.

Figure 9:
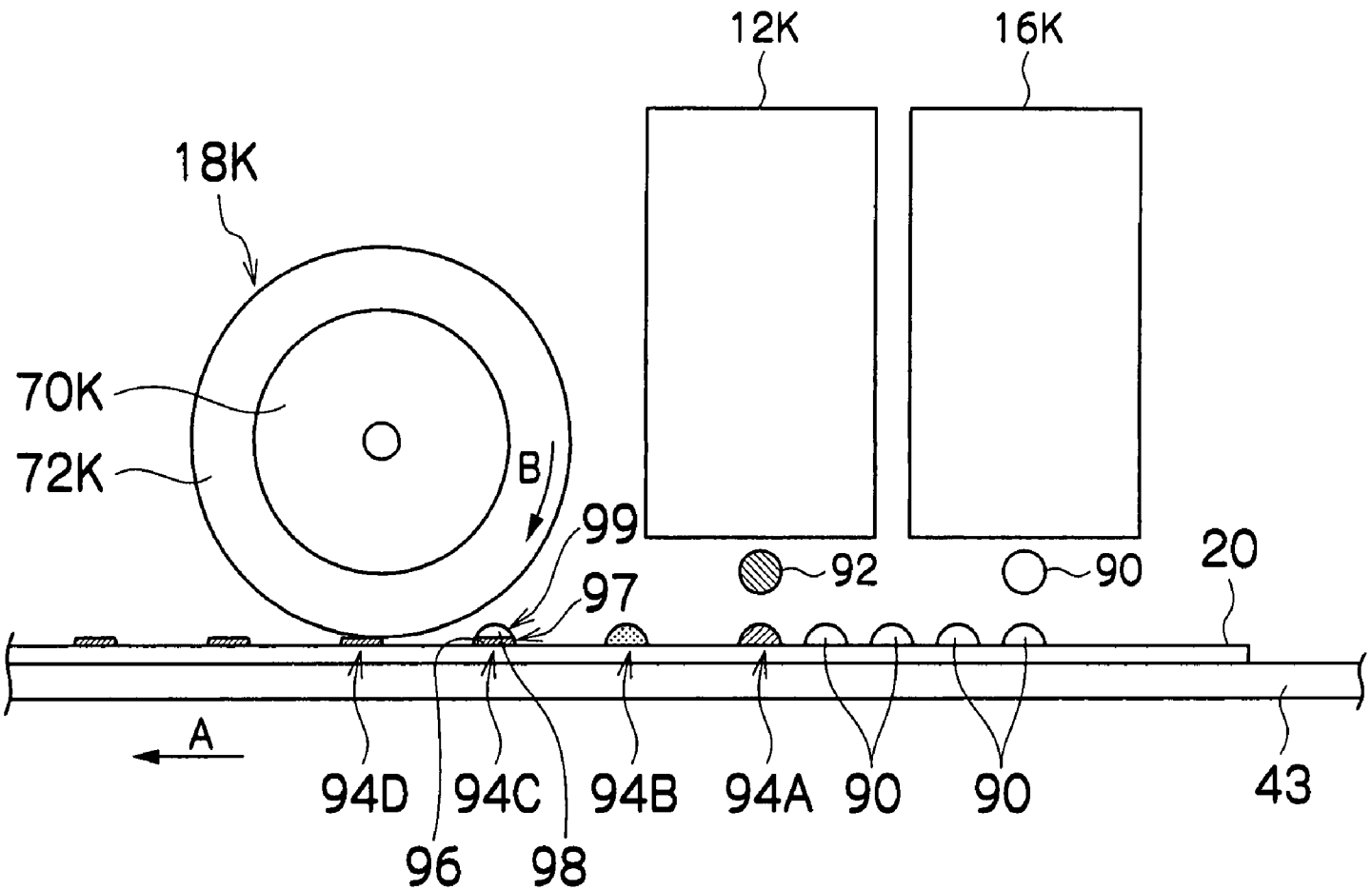
FIG. 9 is a partial enlarged view of the peripheral area of a print head shown in FIG. 8.

FIG. 9 is an enlarged diagram of the peripheral area of the print head 12K shown in FIG. 8. The peripheral areas of the print heads 12K, 12M, 12C and 12Y respectively have the same composition, and therefore the composition of the peripheral area of the print head 12K is described below and description of the peripheral areas of the other print heads 12M, 12C and 12Y is omitted.

As shown in FIG. 9, the treatment liquid head 16K ejects droplets of treatment liquid 90 onto the droplet ejection position of the medium 20, before the print head 12K ejects droplets of ink 92.

The treatment liquid 90 ejected onto the medium 20 from the treatment liquid head 16K lands on the medium 20 and is moved to a position directly below the print head 12K (in the downward direction in FIG. 9), as the medium 20 is conveyed in the paper conveyance direction (the direction indicated by the arrow in FIG. 9). An ink droplet 92 ejected by the print head 12K lands in such a manner that it is superimposed on the treatment liquid 90 on the medium 20, from directly above the treatment liquid 90. Thereby, a combined liquid 94 in which the two liquids, the treatment liquid 90 and the ink droplet 92, are combined, is formed on the medium 20.

In implementing the present invention, the droplet ejection sequence of the treatment liquid heads 16K and the print head 12K is not limited to that of the present embodiment, and it is also possible to adopt a composition in which the treatment liquid head 16K ejects droplets after the print head 12K has ejected droplets, or a composition in which the treatment liquid head 16K and the print head 12K ejects droplets in a substantially simultaneous fashion onto the same droplet ejection position on the medium 20.

The treatment liquid 90 is a liquid which, when mixed with the ink, produces a two-liquid reaction whereby an aggregate of the coloring material is generated, and furthermore, this aggregate of the coloring material is charged with either a positive or negative charge.

As means for generating an aggregate of the coloring material, there are methods such as reacting an anionic coloring material with a cationic compound, producing dispersive breakdown of a pigment-based ink by changing the pH, producing dispersive breakdown of a pigment-based ink by reaction with a multivalent metallic salt, or the like. As means for applying a charge to the aggregate of the coloring material, there are methods such as adjusting the composition of the ink or treatment liquid in such a manner that an anionic or cationic base remains on the surface of the aggregate of the coloring material during anionic/cationic reaction, or controlling the surface potential of a pigment by adjusting the pH, or the like.

Figure 10:
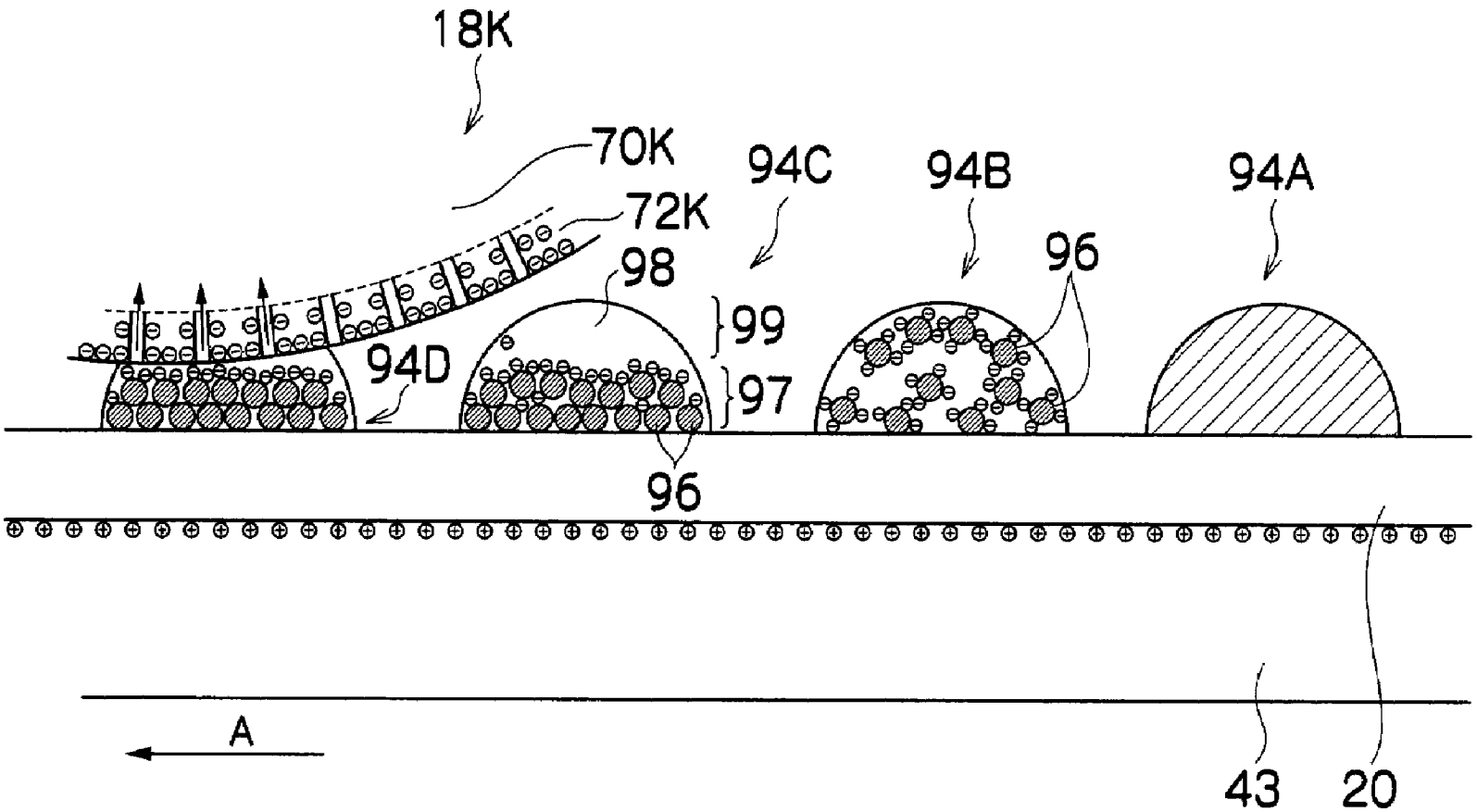
FIG. 10 is an enlarged diagram of a combined liquid on a medium.

Next, a two-liquid reaction between ink and treatment liquid is described with reference to FIG. 10. FIG. 10 is an enlarged diagram of a combined liquid on the medium 20.

In the example shown in FIG. 10, the combined liquid 94A comprising the treatment liquid 90 ejected from the treatment liquid head 16K and the ink 92 ejected from the print head 12K changes into a combined liquid 94B containing a negatively charged coloring material aggregate 96, due to reaction between the two liquids. Thereupon, the coloring material aggregate 96 in the combined liquid 94B settles to the bottom, and the combined liquid 94B changes into a combined liquid 94C in which a coloring material layer 97 formed by the coloring material aggregate 96 is separated from a solvent layer 99 formed by the solvent 98.

The conveyance belt 43 is charged to the opposite polarity of the coloring material aggregate 96. In the present embodiment, the conveyance belt 43 (see FIG. 8) which is connected to the positive terminal of the DC power supply 100 is charged to a positive charge, with respect to the negatively charged coloring material aggregate 96, as shown in FIG. 10.

By charging the conveyance belt 43 and the coloring material aggregate 96 to opposite polarities, electrostatic attraction acts in such a manner that the coloring material aggregate 96 is drawn toward the conveyance belt 43, and therefore, the downward settling of the coloring material aggregate 96 can be further accelerated and the coloring material 96 and the solvent 98 can be separated reliably.

Next, the step of removing the separated solvent layer will be described.

In FIG. 9, the porous roller 18K has a structure in which a thin layer of porous member 72K is formed on the surface of a metal roller 70K. Furthermore, the porous roller 18K is disposed in such a manner that a small gap is formed between the bottommost portion of the porous roller 18K and the medium 20, and the porous roller 18K is composed in such a manner that it absorbs solvent 98 from the combined liquid 94C on the medium 20, while rotating in the direction of arrow B in FIG. 9.

When the combined liquid 94C having the separated coloring material layer 97 and solvent layer 99 is moved to a position directly below the porous roller 18K, due to the conveyance of the medium 20 in the paper conveyance direction (the direction indicated by arrow A in FIG. 9), then the solvent 98 in the solvent layer 99 is absorbed by the porous member 72K, due to capillary action. Consequently, the combined liquid 94C becomes a combined liquid 94D which is composed almost solely of coloring material 96.

Since the porous roller 18K is shaped like a roller, it is able to rotate in such a manner that it has a relative speed of 0 with respect to the medium 20. Therefore, shaking of the image due to disturbance of the ink is prevented. In implementing the present invention, the shape of the solvent absorbing device, such as the porous roller 18K is not limited to a roller shape, and it may also be a belt shape, or the like.

Furthermore, the porous roller 18K is charged to the same polarity as the coloring material aggregate 96. As shown in FIG. 10, in the present embodiment, the porous roller 18K (see FIG. 8) which is connected to the negative terminal of the DC power supply 100 is charged to a negative charge, with respect to the negatively charged coloring material aggregate 96. By charging the porous roller 18K and the coloring material aggregate 96 to the same polarity in this way, a force of electrostatic repulsion acts so as to separate the coloring material aggregate 96 from the porous member 72K, and therefore, it is possible to prevent the coloring material aggregate 96 from adhering to the surface of the porous member 72K when the porous member 72K absorbs the solvent 98.

Furthermore, as stated above, since the conveyance belt 43 is charged to the opposite polarity of the coloring material aggregate 96, then an effect is obtained which suppresses the movement of the coloring material aggregate 96 toward the porous roller 18K when the porous roller 18K absorbs the solvent 98, and hence the adherence of coloring material aggregate 96 to the surface of the porous member 72K can be prevented even more reliably.

Desirably, the diameter of the pores in the porous member 72K which absorbs the solvent 98 are sufficiently smaller than the diameter of the coloring material aggregate 96. Due to a filtering effect, it is possible to prevent coloring material aggregate 96 from being absorbed into the porous member 72K along with the solvent 98.

By generating a coloring material aggregate 96 which is charged either positively or negatively by means of a two-liquid reaction between ink 92 and treatment liquid 90 in this way, it is possible reliably to separate the coloring material 96 and the solvent 98. Moreover, since the surface of the conveyance belt 43, which forms the medium 20 conveyance device, is charged to the opposite polarity to the coloring material aggregate 96, and the surfaces of the porous rollers 18K, 18M, 18C and 18Y, which form the solvent absorbing devices, are charged to the same polarity as the coloring material aggregate 96, then it is possible to absorb the solvent 98 more reliably and swiftly, in a state where the coloring material 96 is fixed onto the medium 20.

Further Embodiments

Figure 11:
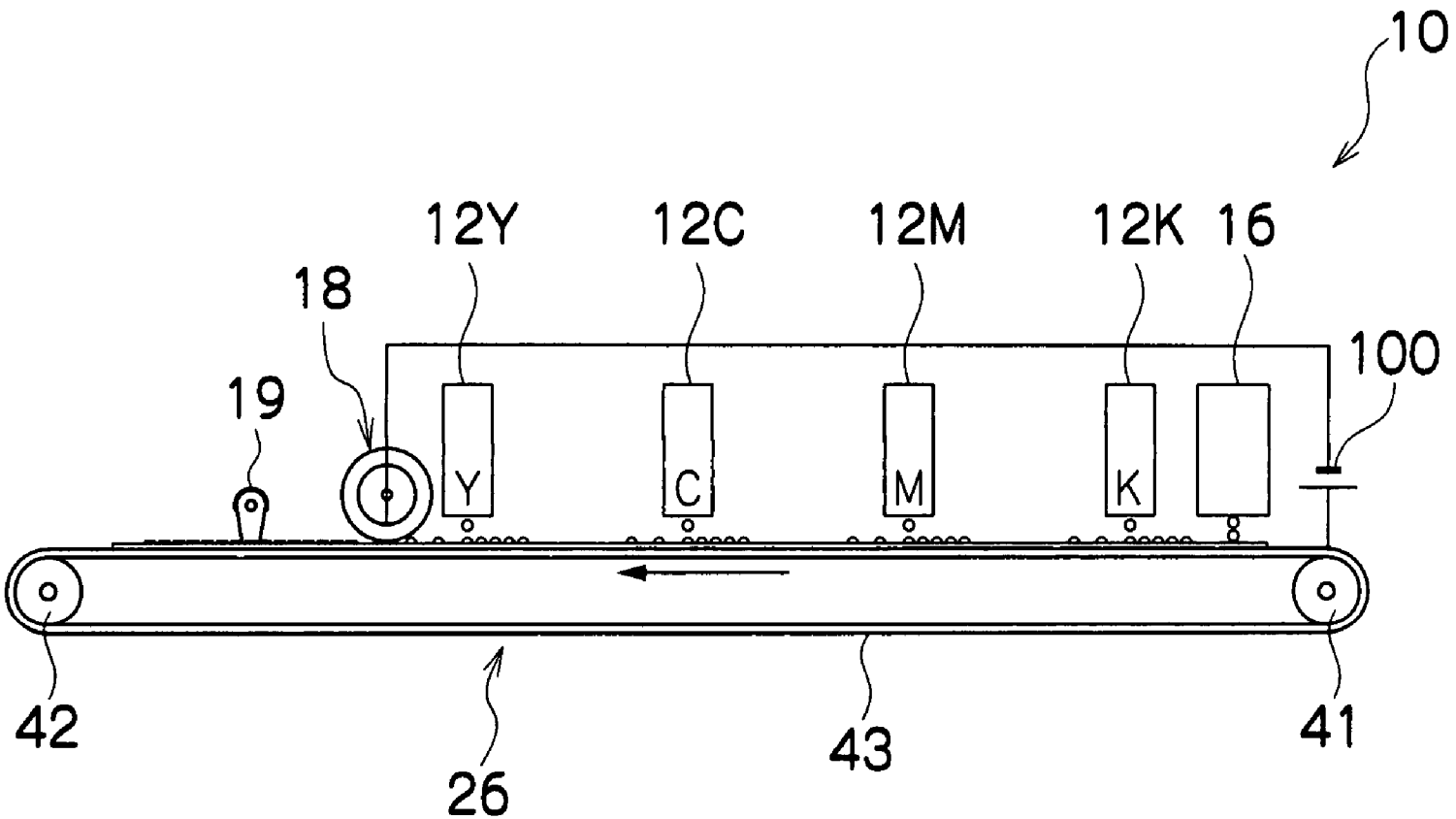
FIG. 11 is a schematic drawing showing the principal composition of an inkjet recording apparatus according to a second embodiment of the present invention.
Figure 12:
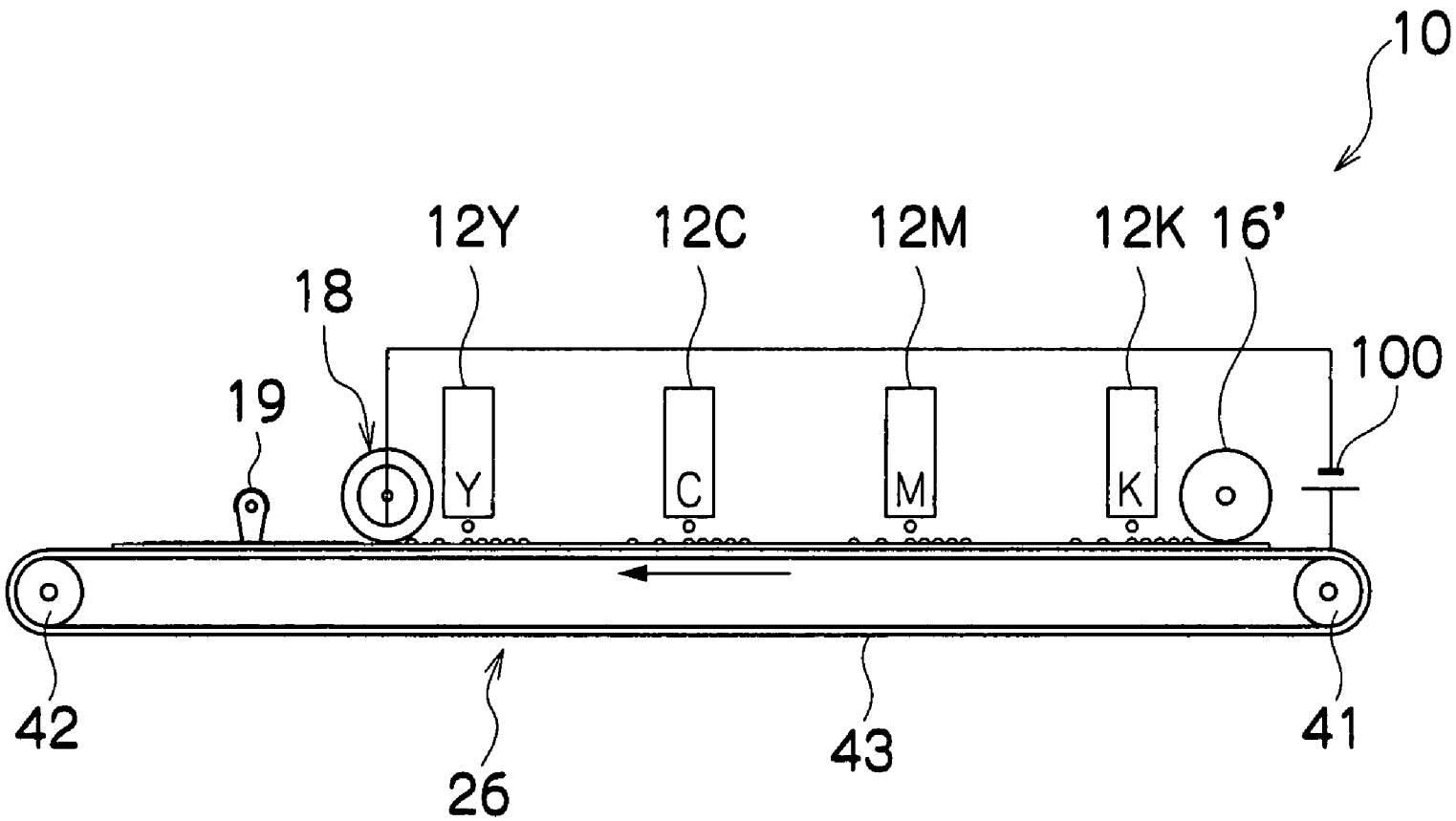
FIG. 12 is a schematic drawing showing the principal composition of an inkjet recording apparatus according to a third embodiment of the present invention.

FIG. 11 shows a schematic drawing which depicts the principal composition of the inkjet recording apparatus 10 according to a second embodiment of the present invention, and FIG. 12 shows a schematic drawing which depicts the principal composition of an inkjet recording apparatus 10 according to a third embodiment of the present invention.

In the first embodiment, treatment liquid heads 16K, 16M, 16C and 16Y are disposed respectively on the upstream sides of the print heads 12K, 12M, 12C and 12Y, as shown in FIG. 8, but in the second embodiment, only one treatment liquid head 16 is disposed on the upstream side of the print head 12K in terms of the paper conveyance direction (the left-hand side in FIG. 11), as shown in FIG. 11.

Furthermore, in the third embodiment, as shown in FIG. 12, only one treatment liquid coating roller 16' is disposed on the upstream side of the print head 12K in terms of the paper conveyance direction (the right-hand side in FIG. 12).

Moreover, in the second embodiment and the third embodiment, one porous roller 18 is provided on the downstream side of the print head 12Y in terms of the paper conveyance direction.

The first and second embodiments are able to reduce the consumption of treatment liquid by controlling the amount of treatment liquid ejected in accordance with the ink droplet ejection pattern. Furthermore, the third embodiment is able to coat the recording medium with a treatment liquid of high viscosity, which is difficult to eject in the form of liquid droplets from a treatment liquid head.

The image forming apparatus according to the present invention has been described in detail above, but it should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ink ejection device which ejects ink comprising a coloring material dispersed or dissolved in a solvent onto a recording medium;

a treatment liquid application device which applies a treatment liquid which produces a charged aggregate of the coloring material by reaction with the ink onto the recording medium, in such a manner that two liquids of the ink and the treatment liquid combine on the recording medium;

a conveyance device which causes the ink ejection device and the recording medium to move relatively to each other by conveying at least one of the ink ejection device and the recording medium in a direction substantially perpendicular to a breadthways direction of the recording medium; and a solvent absorbing device which is charged to a same polarity as the aggregate of the coloring material and absorbs the solvent in the ink on the recording medium, wherein:

the coloring material and the solvent are separated by reaction of the two liquids which have combined on the recording medium;

the solvent is then absorbed by the solvent absorbing device; and the coloring material is then fixed onto the recording medium.

2. The image forming apparatus as defined in claim 1, wherein the treatment liquid application device is a treatment liquid ejection device which ejects droplets of the treatment liquid onto the recording medium.

3. The image forming apparatus as defined in claim 1, wherein the treatment liquid application device is a treatment liquid coating device which coats the recording medium with the treatment liquid.

4. The image forming apparatus as defined in claim 1, wherein the conveyance device is charged to a polarity opposite to the aggregate of the coloring material and conveys the recording medium in the direction substantially perpendicular to the breadthways direction of the recording medium.

5. The image forming apparatus as defined in claim 1, wherein at least a surface of the solvent absorbing device is constituted by a porous member, a diameter of pores of the porous member being smaller than a particle diameter of the aggregate of the coloring material.

6. The image forming apparatus as defined in claim 5, wherein a shape of the porous member is one of a belt shape and a roller shape.

7. The image forming apparatus as defined in claim 1, wherein:

at least a surface of the solvent removing device is constituted by a porous member; and the surface of the porous member is spaced from the recording medium by a small gap.

8. The image forming apparatus as defined in claim 7, wherein a diameter of pores of the porous member is smaller than a particle diameter of the aggregate of the coloring material.

9. The image forming apparatus as defined in claim 7, wherein a shape of the porous member is one of a belt shape and a roller shape.

10. An image forming apparatus, comprising:

an ink ejection device which ejects ink comprising a coloring material dispersed or dissolved in a solvent onto a sheet;

a treatment liquid application device which applies a treatment liquid which produces a charged aggregate of the coloring material by reaction with the ink onto the sheet, in such a manner that two liquids of the ink and the treatment liquid combine on the sheet;

a conveyance device which causes the ink ejection device and the sheet to move relatively to each other by conveying at least one of the ink ejection device and the sheet in a direction substantially perpendicular to a breadthways direction of the sheet; and a solvent absorbing device which is charged to a same polarity as the aggregate of the coloring material and absorbs the solvent in the ink on the sheet, wherein:

the coloring material and the solvent are separated by reaction of the two liquids which have combined on the sheet;

the solvent is then absorbed by the solvent absorbing device; and the coloring material is then fixed onto the sheet.

11. The image forming apparatus as defined in claim 10, wherein the treatment liquid application device is a treatment liquid ejection device which ejects droplets of the treatment liquid onto the sheet.

12. The image forming apparatus as defined in claim 10, wherein the treatment liquid application device is a treatment liquid coating device which coats the sheet with the treatment liquid.

13. The image forming apparatus as defined in claim 10, wherein the conveyance device is charged to a polarity opposite to the aggregate of the coloring material and conveys the sheet in the direction substantially perpendicular to the breadthways direction of the sheet.

14. The image forming apparatus as defined in claim 10, wherein at least a surface of the solvent absorbing device is constituted by a porous member, a diameter of pores of the porous member being smaller than a particle diameter of the aggregate of the coloring material.

15. The image forming apparatus as defined in claim 14, wherein a shape of the porous member is one of a belt shape and a roller shape.

* * * * *